US005743788A

United States Patent [19]

Vanell

[11] Patent Number: 5,743,788

[45] Date of Patent: Apr. 28, 1998

[54] PLATEN COATING STRUCTURE FOR CHEMICAL MECHANICAL POLISHING AND METHOD

[75] Inventor: James F. Vanell, Tempe, Ariz.

[73] Assignee: Motorola, Inc., Schaumburg, Ill.

[21] Appl. No.: 755,870

[22] Filed: Dec. 2, 1996

[51] Int. Cl.[6] ..... B24C 7/22

[52] U.S. Cl. ..... 451/41; 451/548

[58] Field of Search ..... 451/41, 905, 287, 451/288, 290, 548, 550

[56] References Cited

U.S. PATENT DOCUMENTS

| | | | |
|---|---|---|---|
| 5,183,402 | 2/1993 | Cooke et al. | 432/5 |
| 5,558,717 | 9/1996 | Zhao et al. | 118/715 |
| 5,584,146 | 12/1996 | Shamouillan et al. | 451/41 |

OTHER PUBLICATIONS

Metco Perkin Elmer, Handbook of Coating Recommendations, "Oxide Ceramic Coating", 1988, pp. 1–7.

*Primary Examiner*—Robert A. Rose
*Attorney, Agent, or Firm*—Kevin B. Jackson

[57] ABSTRACT

A structure for protecting chemical mechanical polishing (CMP) apparatus components from corrosion includes a refractory metal oxide coating layer (33) formed over surfaces of a platen (32). In a preferred embodiment, the refractory metal oxide coating layer (33) is a plasma-flame sprayed chromium-oxide layer. In an alternative embodiment, a sealer layer (42) is placed at least within pores (41) of refractory metal oxide coating layer (33) for additional protection. The refractory metal oxide coating layer (33) is also suitable for protecting other CMP apparatus components that are susceptible to corrosion.

29 Claims, 2 Drawing Sheets

-PRIOR ART-

PLATEN COATING STRUCTURE FOR CHEMICAL MECHANICAL POLISHING AND METHOD

BACKGROUND OF THE INVENTION

This invention relates, in general, to semiconductor processing and more particularly, to structures and methods for polishing or planarizing materials.

Chemical mechanical polishing (CMP) is a commonly used technique in semiconductor manufacturing to planarize a layer or layers of material formed on a semiconductor substrate before depositing a subsequent layer. To planarize a layer of material, the semiconductor substrate is placed onto a CMP apparatus that includes a platen, a polishing pad mounted onto the platen, and a polishing arm that holds, moves, and rotates the semiconductor substrate over the polishing pad while the platen moves. A slurry is deposited onto the polishing pad and together with platen speed of movement (e.g., rotational, orbital motion, or translational), pressure, and temperature acts to both chemically and mechanically remove material from the semiconductor substrate Slurries in current use tend to react with components of the CMP apparatus thereby causing corrosion to occur. This reduces the effective life of the components. Also, the corrosion results in process contamination and undesirable process variation. As semiconductor manufacturers incorporate new materials into semiconductor fabrication processes, new slurry chemistries are being developed that may be more corrosive than existing slurry chemistries.

Therefore, methods and structures are needed that reduce the susceptibility of CMP apparatus components to process related corrosion. Such methods and structures should be reliable and cost effective, and should not introduce variation and contamination into the CMP process.

DETAILED DESCRIPTION OF THE DRAWINGS

In CMP processing, it is important for the platen structure to be flat and to have the correct geometry. If it does not, a substrate being processed will not be polished or planarized to a high degree of flatness. Additionally, it is important for the platen structure to be resistant to the chemicals used to polish or planarize the substrate. In general, the present invention relates to coatings formed on surfaces of CMP apparatus components such as platen structures to make them more resilient to the planarization process environment.

Figure 1:
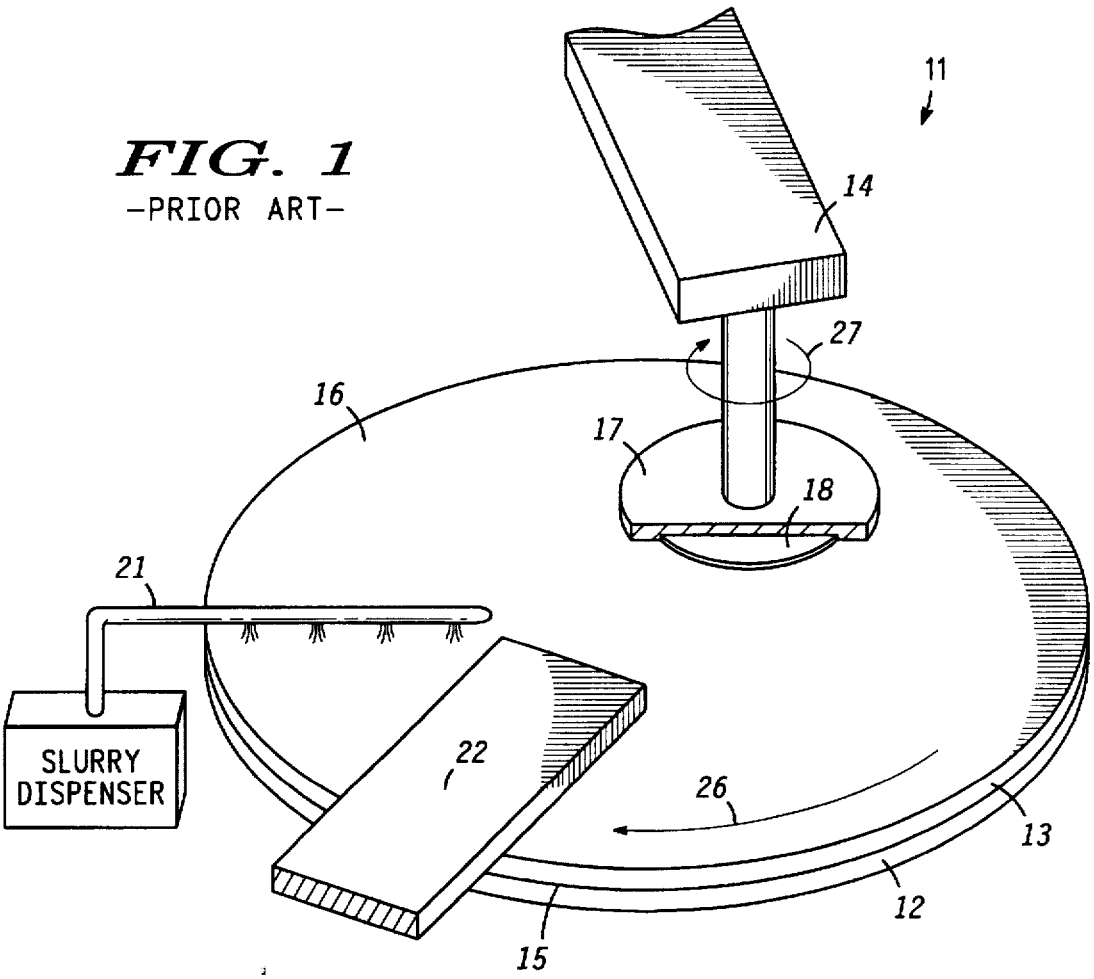
FIG. 1 illustrates a perspective view a CMP apparatus according to the prior art.

FIG. 1 illustrates a simplified perspective view of a prior art CMP apparatus 11 that includes a platen or moving support member 12 and a polishing pad 13. A polishing arm 14 with a polishing head or carrier assembly 17 (shown in a cut-away view) holds a semiconductor substrate, wafer, substrate, or work piece 18 under a set force against polishing pad 13. Substrate 18 includes a layer of material to be removed. Alternatively, substrate 18 itself is polished.

CMP apparatus 11 further includes a slurry dispense device 21, which deposits slurry onto polishing pad 13, and a conditioning assembly 22 for conditioning polishing pad 13. CMP products such as CMP apparatus 11 are available from companies such as IPEC/Planar of Phoenix, Ariz., Speedfam of Chandler, Ariz., Applied Materials of Santa Clara, Calif., and Strasbaugh of San Luis Obispo, Calif.

During a polishing process, platen 12 and polishing pad 13 are rotated according to arrow 26 (or in the opposite direction) and polishing head 17 and wafer 18 rotate according to arrow 27 (or in the opposite direction). Additionally, polishing arm 14 oscillates back and forth across polishing pad 13. Polishing slurry is dispensed from slurry dispense device 21 and material(s) is removed from substrate 18 by well known chemical and mechanical means.

Platen 12 typically is made of aluminum or stainless steel. Aluminum is preferred because it has less mass, has better heat transfer characteristics, and is less expensive than stainless steel. However, because aluminum is amphoteric, it is susceptible to corrosion by both acidic and basic slurry mixtures.

Corrosion typically occurs from outer edge 15 of platen 12 inward. This destroys the flatness of platen 12 causing semiconductor manufacturers to make process adjustments to avoid polishing on outer portion 16 of pad 13 and platen 12. This in turn increases polishing time. Also, the corrosion reduces the useful life of platen 12 thereby increasing processing costs and increasing process down time. In addition, the corrosion generates particulates that can damage substrate 18 while it is being polished.

Anodizing is one technique used to protect aluminum platens. However, when semiconductor manufacturers attach polishing pad 13 to platen 12 and trim it to fit, the instrument used to trim pad 13 often damages the anodized coating. As a result, corrosion can begin to occur in the damaged areas, spread under the anodized coating for the initial points of corrosion, and eventually remove the anodized coating entirely. The aluminum base metal is then susceptible to severe chemical attack.

In an alternative approach, front end tool manufacturers have placed polymer materials (e.g., epoxy materials) on platen 12 for added protection. One disadvantage with polymer materials is that they have a poor surface hardness and are easily damaged, especially during the pad trimming process. Also, the polymer coatings have poor heat transfer characteristics, which can detrimentally impact the polishing process. Platen 12 typically is water cooled to remove heat generated during the polishing process. The polymer films act to insulate pad 13 from platen 12 thereby reducing the ability of platen 12 to remove heat from pad 13.

Although stainless steel platens are less susceptible to corrosion than aluminum platens in some slurry chemistries, they are still attacked in other slurry chemistries. Also, stainless steel platens are significantly more expensive than aluminum platens. Additionally, due to their weight, stainless steel platens require more powerful drive motors, which adds equipment and operating expense. Also, stainless steel platens have poor heat transfer characteristics thereby requiring semiconductor manufacturers to make process modifications, such as slowing the removal rate to avoid excessive heat build-up. This decreases process throughput. Stainless steel platens are also susceptible to damage during the pad trimming process.

Figure 2:
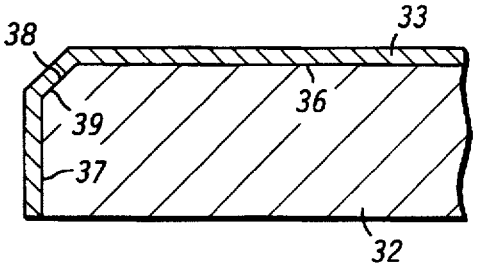
FIG. 2 illustrates a cross-sectional view of portion of a platen structure according to the present invention.

FIG. 2 illustrates a cross-sectional view of a portion of a platen or support member 32 according to the present invention. Platen 32 preferably comprises aluminum, stainless steel, or the like. Platen 32 includes a coating or protective layer 33 formed or deposited onto or over a major surface 36 of platen 32. Major surface 36 supports pad 13 and substrate 18 as shown in FIG. 1 with prior art platen 12.

Preferably, coating 33 is formed on an outer side surface 37 of platen 32 as shown in FIG. 2. Coating 33 preferably is formed over all surfaces of platen 32 that are exposed to slurry materials. In an alternative embodiment, coating 33 is also formed on the lower surface of platen 32, although this surface is typically protected from slurry materials due to its location on the CMP apparatus.

In a preferred embodiment, a chamfer or bevel 38 is formed at upper outer edge 39 of platen 32. Chamfer 38 is preferred to eliminate sharp edges, which, among other things, can be difficult to cover with coating 33. This also reduces the potential for edge chipping, which can expose the underlying platen and lead to corrosion.

According to the present invention, coating 33 comprises a refractory metal oxide material or an oxide ceramic material. Preferably, coating 33 comprises a chromium-oxide layer or the like. Coating 33 is formed using plasma-flame spray, thermal spray, chemical vapor deposition (CVD), or paint-on techniques. Preferably, coating 33 has a thickness in a range from about 0.125 millimeters (mm) to about 0.500 mm (about 5 mils to 20 mils).

The following is a preferred process sequence for forming coating 33 over platen 32. Chamfer 38 is first formed at upper outer edge 39 of platen 32. If platen 32 comprises aluminum, any existing anodized layer is then removed. The surfaces of platen 32 that will be coated are then grit blasted (e.g., using garnet) to roughen and clean platen 32. Next, coating 33 is deposited onto platen 32. Plasma-flame spray processing in an argon shield is one preferred technique to deposit coating 33 because it provides an inert ambient for the deposition. This reduces native oxide formation thereby promoting film adhesion.

When using a plasma-flame spray technique, it is preferred that platen 32 be maintained at a temperature from about 120 degrees centigrade (° C.) to about 150° C. A chromium-oxide source such as a METCO P106 chromium-oxide or its equivalent (e.g., NORTON 328) is suitable. METCO P106 chromium-oxide is available from METCO of Westbury, N.Y. Preferably, the nozzle used in the plasma-flame spraying process is changed often and kept clean during the process to avoid forming undesirable coating irregularities (e.g., bumps). Plasma-flame spray processing services are available from Advanced Materials Technologies Incorporated (AMTI) of Tempe, Ariz.

Figure 3:
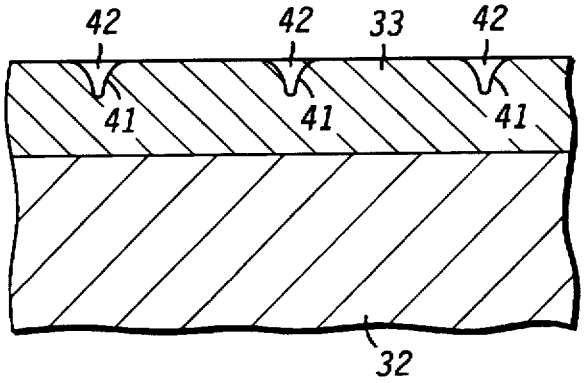
FIG. 3 illustrates an additional embodiment of a portion of a platen structure according to the present invention.

After forming coating 33, platen 32 is cleaned using virgin acetone in an ultrasonic bath. Next, and as shown in FIG. 3, a sealer layer 42 preferably is formed over coating 33 at least to fill any pores 41 present in coating 33 to provide additional protection. Preferably, sealer layer 42 comprises a paraffin wax such as a METCO 185 sealer available from METCO. To apply sealer layer 42, platen 32 is heated to an appropriate temperature (approximately 95° C. for the METCO 185 sealer) and the sealer is then rubbed over coating 33 until pores 41 are filled (this typically occurs when the sealer stops disappearing and starts to accumulate above the pores). Preferably, small chamfers are then cut around the lower periphery of the platen, around the center hole in the platen, and around any key holes present in the side of the platen. If these chamfers are added, platen 32 is resealed with sealer layer 42 in these areas. Alternatively, these additional chamfers are formed before coating 33 is deposited.

Once sealed, platen 32 is reassembled to attach cooling fixtures and then placed onto a CMP apparatus. Preferably, platen 32 is continuously rinsed in de-ionized water for approximately 24 hours once it has been placed onto the CMP apparatus.

One major requirement for coating 33 is that it must adhere well to platen 32. This is because pad 13 typically is attached to platen 32 using a pressure sensitive adhesive (PSA) or like means. Significant force is required to remove a worn pad for replacement. This force can lead to the delamination of a protective coating. Adhesion testing was performed on plasma-flame sprayed chromium-oxide samples formed using the above process. A CR Politex pad material was attached to the samples using a PSA material appropriate for CMP processing. Results showed an average of 25.5 ounces/half inch (with a standard deviation of 1.85) for an immediate peel test, an average of 30.5 oz/half inch (with a standard deviation of 1.5) for peel test 24 hours after the formation of the coating, and an average of 19.0 oz/half inch (with a standard deviation of 0.45) for a peel test after 18 hours of slurry submerge. These results show that coating 33 adheres well to platen 32.

Also, it was found that the plasma-flame sprayed chromium-oxide coating and the paraffin wax sealer provide excellent heat transfer characteristics. This was unexpected, due to the insulating nature of oxide ceramic materials such as refractory metal oxides. Also, the plasma-flame sprayed chromium oxide coating is resistant to substantially all of the elements present in slurry chemistries. Additionally, the coating has a high surface hardness making it resistant to damage from the pad trimming process. Furthermore, it was found that if damage does occur to coating 33, platen 32 may be reworked using the plasma-flame spray process without having to strip the entire coating. This saves on reprocessing costs.

Figure 4:
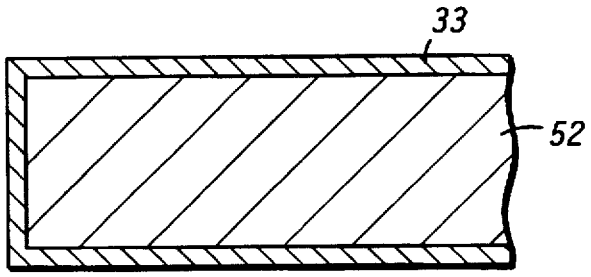
FIG. 4 illustrates a further embodiment of a portion of a CMP apparatus according to the present invention.

FIG. 4 illustrates an enlarged cross sectional view of a CMP apparatus component according to the present invention. Component 52 comprises a metal such as aluminum, stainless steel or the like. Examples of component 52 include the carrier apparatus (such as that shown in FIG. 1), the conditioning apparatus (such as that shown in FIG. 1), and/or the like. Coating 33 is deposited onto component 52 to protect those surfaces that will be exposed to slurry during processing. Coating 33 is formed using the above described techniques.

By now it should appreciated that there has been provided a refractory metal oxide coating that adheres well to metal CMP apparatus components, that is resistant to substantially all of the elements present in slurry chemistries, that provides good heat transfer characteristics, and that has a high surface hardness. Additionally, application of the coating using plasma-flame spray techniques is cost effective.

What is claimed is:

1. A substrate planarization apparatus comprising:

a carrier structure for holding the substrate during planarization;

a platen having a first major surface that provides support for the substrate during planarization; and a coating formed on the first major surface to protect the first major surface from corrosion, wherein the coating comprises a refractory metal oxide.

2. The structure of claim 1 wherein the coating comprises chromium-oxide.

3. The structure of claim 1 wherein the coating comprises a plasma flame sprayed refractory metal oxide.

4. The structure of claim 1 further comprising a sealer layer formed over the coating.

5. The structure of claim 4 wherein the sealer layer comprises a paraffin wax.

6. The structure of claim 1 wherein the platen comprises aluminum.

7. The structure of claim 1 wherein the platen comprises a stainless steel.

8. The structure of claim 1 wherein the platen further comprises an outer side surface and wherein the coating is formed on the outer side surface.

9. The structure of claim 1 wherein the outer side surface includes a chamfer.

10. A method for removing material from a substrate comprising the steps of:

providing a substrate;

placing the substrate onto a CMP apparatus having a platen, wherein the platen includes a major surface and a oxide ceramic coating formed over the major surface; and removing material from the substrate with the CMP apparatus.

11. The method of claim 10 wherein the step of placing the substrate includes placing the substrate onto the CMP apparatus, wherein the platen further includes a sealing layer formed over the oxide ceramic coating.

12. The method of claim 10 wherein the step of placing the substrate includes placing the substrate onto the CMP apparatus, wherein the oxide ceramic coating comprises chromium oxide.

13. The method of claim 10 wherein the step of placing the substrate includes placing the substrate onto the CMP apparatus, wherein the platen further includes an outer side surface and a chamfer formed at an upper outer edge of the platen, and wherein the oxide ceramic coating covers all surfaces of the platen that will be exposed to a slurry during processing.

14. The method of claim 10 wherein the step of placing the substrate includes placing the substrate onto the CMP apparatus, wherein the oxide ceramic coating is a plasma-flame sprayed layer.

15. The method of claim 10 wherein the step of placing the substrate includes placing the substrate onto the CMP apparatus, wherein the platen comprises one of aluminum and stainless steel.

16. The method of claim 10 wherein the step of placing the substrate includes placing the substrate onto the CMP apparatus further including a substrate carrier apparatus having an oxide ceramic coating formed at least on surfaces that will be exposed to slurry during processing.

17. The method of claim 10 wherein the step of placing the substrate includes placing the substrate onto the CMP apparatus further including a pad conditioning apparatus having an oxide ceramic coating formed at least on surfaces that will be exposed to slurry during processing.

18. A method for removing material from a work piece comprising the steps of:

providing a work piece comprising a first material;

placing the work piece onto a polishing apparatus having a support member, wherein the support member includes a major surface for supporting the work piece during polishing, and wherein the support member includes a deposited refractory metal oxide layer formed over the major surface; and removing at least a portion of the first material from the work piece.

19. The method of claim 18 wherein the step of placing the work piece includes placing the work piece onto the polishing apparatus, wherein the support member further includes a sealer layer formed contiguous with the deposited refractory metal oxide layer to seal any pores present in the deposited refractory metal oxide layer.

20. The method of claim 19 wherein the step of placing the work piece include placing the work piece onto the polishing apparatus, wherein the sealer layer comprises a paraffin wax.

21. The method of claim 18 wherein the step of placing the work piece placing the work piece onto the polishing apparatus, wherein the deposited refractory metal oxide layer comprises a chromium-oxide layer.

22. The method of claim 18 wherein the step of placing the work piece includes placing the work piece onto the polishing apparatus, wherein the deposited refractory metal oxide layer comprises a plasma-flame sprayed refractory metal oxide layer.

23. A CMP apparatus comprising:

a metal component having a surface susceptible to corrosion when exposed to a polishing slurry; and a refractory metal oxide protective layer formed over the surface.

24. A process for polishing a substrate comprising the steps of:

providing the substrate;

placing the substrate onto a CMP apparatus including a component having a refractory metal oxide coating formed on a surface; and removing material from the substrate with the CMP apparatus.

25. The process of claim 24 wherein the step of placing includes placing the substrate onto a CMP apparatus, wherein the component comprises a platen.

26. The process of claim 24 wherein the step of placing includes placing the substrate onto a CMP apparatus, wherein the component comprises a pad conditioner apparatus.

27. The process of claim 24 wherein the step of placing includes placing the substrate onto a CMP apparatus, wherein the component comprises a substrate carrier apparatus.

28. The process of claim 24 wherein the step of placing includes placing the substrate onto a CMP apparatus, wherein the component comprises a slurry dispenser apparatus.

29. The process of claim 24 wherein the step of placing includes placing the substrate onto a CMP apparatus, wherein the oxide ceramic protective layer comprises a chromium oxide.

* * * * *